United States Patent [19]

Shirakawa

[11] Patent Number: 4,909,214

[45] Date of Patent: Mar. 20, 1990

[54] THROTTLE VALVE CONTROL DEVICE

[75] Inventor: Hiroyuki Shirakawa, Hyogo, Japan

[73] Assignees: Mitsubishi Denki Kabushiki Kaisha, Tokyo; Sougou Jidousha Anzen Kougai Gijutsu Kenkyu Kumiai, Hyogo, both of Japan

[21] Appl. No.: 210,584

[22] PCT Filed: Sep. 10, 1987

[86] PCT No.: PCT/JP87/00670

§ 371 Date: Jul. 8, 1988

§ 102(e) Date: Jul. 8, 1988

[87] PCT Pub. No.: WO88/02063

PCT Pub. Date: Mar. 24, 1988

[30] Foreign Application Priority Data

Sep. 12, 1986 [JP] Japan ..... 61-216346
Sep. 12, 1986 [JP] Japan ..... 61-216295

[51] Int. Cl.[4] ..... F02D 41/14; F02D 9/02; F02D 11/10

[52] U.S. Cl. ..... 123/361; 123/399

[58] Field of Search ..... 123/352, 361, 376, 399

[56] References Cited

U.S. PATENT DOCUMENTS 4,161,994 7/1979 Collonia ..... 123/361 X
4,601,271 7/1986 Ejiri et al. ..... 123/361
4,612,615 9/1986 Murakami ..... 123/361 X
4,727,840 3/1988 Nishida et al. ..... 123/361 X
4,768,483 9/1988 Asayama ..... 123/399
4,809,656 3/1989 Suzuki ..... 123/361

FOREIGN PATENT DOCUMENTS 0216036 10/1985 Japan .
0008441 1/1986 Japan .
0215436 9/1986 Japan .
0075038 4/1987 Japan ..... 123/399

*Primary Examiner*—Willis R. Wolfe
*Attorney, Agent, or Firm*—Sughrue, Mion, Zinn, Macpeak and Seas

[57] ABSTRACT

The present invention relates to a throttle valve control device for controlling a throttle valve of an engine by an electronic controlled actuator, in which, in order to improve the safety and response speed, first and second driving motors which rotate independently and a driving force conversion mechanism for combining rotational movements of the first and the second driving motors and converting them into a linear movement for transmission are provided to regulate an opening of the throttle valve by the linear movement transmitted from the driving force conversion mechanism and the first and the second driving motors are controlled by control signals from an operation control portion for calculating an optimum opening of the throttle valve.

4 Claims, 3 Drawing Sheets

THROTTLE VALVE CONTROL DEVICE

FIELD OF TECHNOLOGY

The present invention relates to a throttle valve control device of an automobile engine and, particularly, to such device in which a throttle valve of the engine is controlled by an electronic controlled actuator.

BACKGROUND OF TECHNOLOGY

Recently, as a portion of an engine control for improving the feeling of running and the fuel economy of an automobile, a throttle valve control by means of an electronic controlled actuator which does not use any mechanical linkage between a throttle valve and an acceleration pedal and controls an opening of the throttle valve in response to an electric signal obtained by converting an amount of depression of an acceleration pedal and other signals such as engine rotation signal which is representative of engine operating condition and gear position signal which is representative of automobile running condition has been developed.

In the throttle valve control device using such electronic controlled actuator, the throttle valve opening is regulated by a driving motor actuated upon instructions from an automobile control device comprising an operation control portion for sequentially operating an optimum throttle opening according to signals representative of an engine operating condition and automobile running condition. Therefore, it is necessary to have a safety device capable of preventing an uncontrolled running of the automobile even if the electronic controlled actuator becomes inoperative during running of the automobile, and examples of such safety device are shown in Japanese Patent Application Laidopen No. 145867/1980 as (1) provision of a return spring on a throttle shaft which functions to return a throttle valve to a closed position when a control is lost, (2) provision of an electromagnetic clutch for disconnecting a throttle shaft from an electronic controlled actuator when it becomes uncontrollable, or (3) provision of a construction which is a combination of a return spring and an electromagnetic clutch and functions to make the return spring effective when the electromagnetic clutch is separated.

In the conventional schemes such as above, however, once the electronic controlled actuator becomes inoperative, it is impossible to maintain a running of an automobile and thus it becomes impossible to move the automobile to a repairing place, although it is possible to prevent an uncontrolled running of the automobile.

The present invention was made in view of solving this problem and an object of the present invention is to provide a throttle valve control device which is highly reliable and has a high speed response.

DISCLOSURE OF THE INVENTION

That is, the throttle valve control device according to the present invention comprises a first and a second driving motors which are independent on each other and a driving force conversion mechanism which combines rotational movements of these driving motors and converts a combined movement into a linear movement. The first and the second driving motors are controlled on the basis of control signals from an operation control portion for calculating an optimum throttle opening sequentially. With this construction, the throttle valve opening can be controlled so long as both the first and the second driving motors become inoperative. When both of the driving motors are operative, an operation speed of the throttle valve becomes twice that when one of the motors operates, resulting in a highly safe control device which is inexpensive and has a high response speed.

BEST MODE FOR PRACTICING THE PRESENT INVENTION

The present invention will be described in detail with reference to the drawings.

Figure 1:
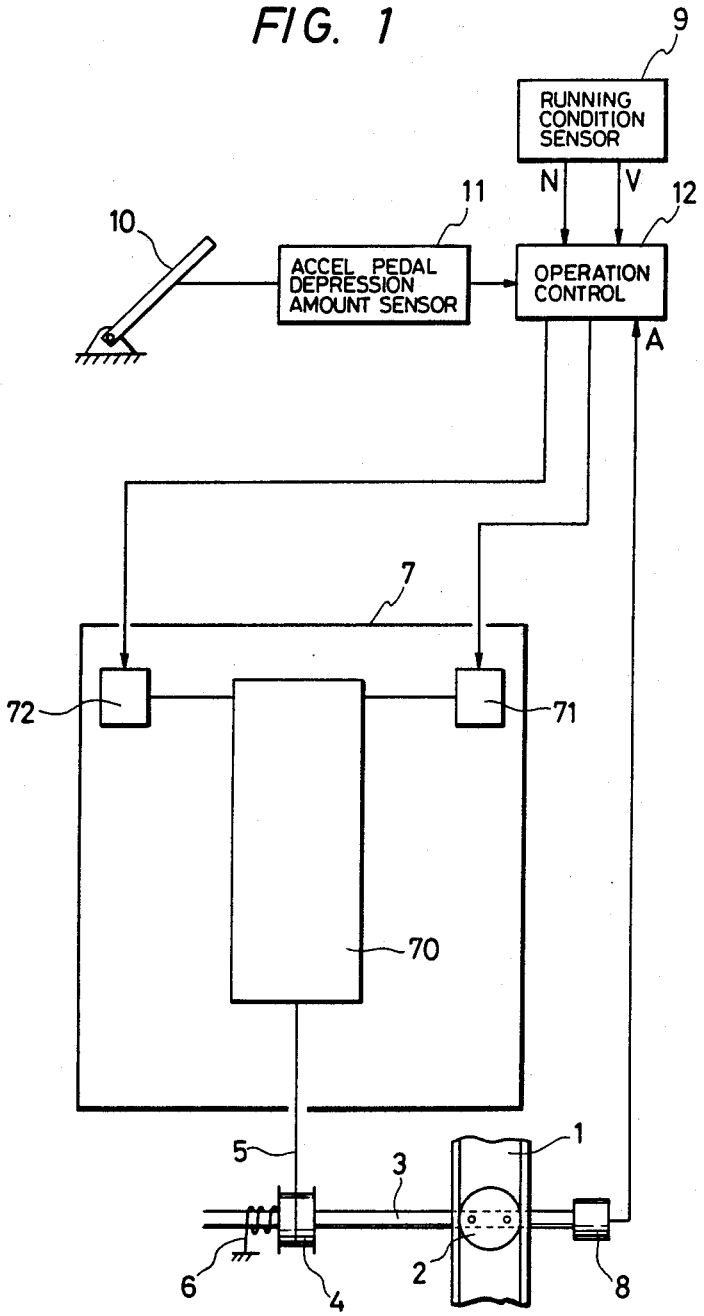
FIG. 1 shows a general construction of an automobile control device including the present throttle valve control device and FIGS. 2 and 3 show concrete embodiments of the present invention, respectively.

FIG. 1 shows a general construction of an automobile control device including the present throttle valve control device, in which 1 depicts an air suction tube of an engine (not shown) and 2 a throttle valve.

The throttle valve 2 rotates around a valve shaft 3 to which a disc 4 is fixedly secured. An acceleration wire 5 is wound in a groove of the disc 4. The acceleration wire 5 is tensioned by a return spring 6.

The return spring 6 is mounted on the valve shaft 3 helically and has one end fixed to the disc 4. A torque in a direction in which the throttle valve 2 is returned to a closed position is applied to the valve shaft 3 by this return spring 6.

An opening sensor 8 is mounted on the valve shaft 3. The opening sensor 8 is to detect an opening A of the throttle valve and a detection output thereof is supplied to an operation control portion 12.

7 depicts a base of an actuator. A pair of driving motors 71 and 72 which have identical characteristics are provided on the base 7. Rotational movements of the driving motors 71 and 72 are transmitted to a driving force conversion mechanism 70, independently, in which these movements are converted into a linear movement to pull-up the acceleration wire 5.

Figure 2:
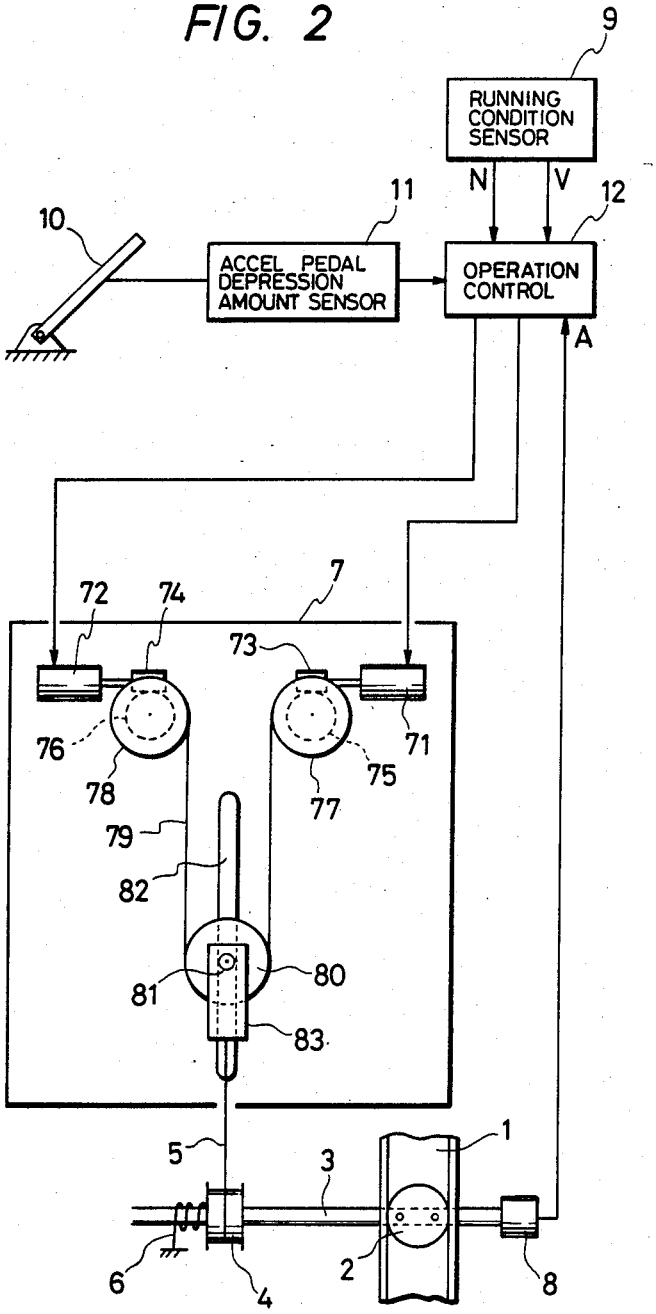

FIG. 2 shows an embodiment of the driving force conversion mechanism 70.

In the embodiment in FIG. 2, worm gears 73 and 74 are mounted on output shafts of the respective driving motors 71 and 72, which mesh with worm wheels 75 and 76, respectively.

Pulleys 77 and 78 are provided integrally with the worm wheels 75 and 76, respectively, and are mounted rotatably on the base 7.

One end of a wire 79 is connected to the pulley 77 and can be wound thereon and the other end is connected to the pulley 78 and can be wounded thereon.

A third pulley 80 is disposed in contact with the wire 79. A center shaft 81 of the third pulley 80 is inserted into a groove 82 formed in the base 7 slidably in vertical directions.

A hook 83 is fitted on the center shaft 81, to which one end of the acceleration wire 5 is fixed. The other end of the acceleration wire 5 is wounded on the groove of the disc 4.

A running condition detecting sensor 9 detects, for example, engine rotation N and running speed V as running condition of an automobile. The engine rotation N and the running speed V are sent to the operation control portion 12.

A depression amount of an acceleration pedal 10 is detected by an acceleration amount sensor 11. An output of the depression amount sensor 11 is also supplied to the operation control portion 12.

The operation control portion 12 receives the outputs of the running condition detecting sensor 9 and the acceleration amount sensor 11 and processes them according to predetermined programs to provide an aimed opening of the throttle valve 2 and to compare an output signal of the throttle opening sensor 8 with the aimed opening to provide rotation signals to the driving motors 71 and 72 according to a deviation therebetween.

An operation of the invention will be described. The rotational forces of the driving motors 71 and 72 are applied through the worm wheels 73 and 75 and the worm wheels 74 and 76 to the pulleys 77 and 78, respectively independently.

The wire 79 provided between the pulleys 77 and 78 have the one end connected to the pulley 77 and the other end connected to the pulley 78, as mentioned. Therefore, in FIG. 2, when the pulley 77 is rotated in clockwise direction while the pulley 78 is rotated in counterclockwise direction, the wire 79 is wound on the respective pulleys and thus the third pulley 80 sidposed in contact with the wire 79 is pulled up.

A moving speed $v_o$ of the third pulley 80 has the following relation with respect to moving speeds $v_1$ and $v_2$ ($v_1$ and $v_2$ include directions, respectively) of the wire 79 on the sides of the respective pulleys 77 and 78

$$v_o = (v_1 + v_2)/2$$

Assuming $v_1 = v_2$, the third pulley 80 moves at the same speed that of the wire 79 without rotation and when $v_1$ is different from $v_2$, the pulley 80 moves at an average speed while rotating.

When the third pulley 80 moves in this manner, the acceleration wire 5 is pulled through the hook 83 mounted on the third pulley 80 to thereby regulate the opening of the throttle valve 2.

The operation control portion 12 calculates an aimed opening of the throttle valve 2 on the basis of an acceleration opening A detected by the opening sensor 8, the engine rotation N and the speed V of the automobile and supplies rotation instructions to the driving motors 71 and 72 of the above described driving portion such that a difference between the opening of the throttle valve 2 and the output signal of the opening sensor 8 becomes zero.

Contents of each rotation instruction includes rotation direction, power supply (rotation), power stop (stop), braking, etc., of the associated driving motor depending upon the operation mode thereof.

In the throttle valve control device according to the present invention, it is possible to control the opening of the throttle valve 2 so long as both of the driving motors 71 and 72 become inoperative simultaneously. When both of the motors 71 and 72 operate, the moving speed of the throttle valve 2 becomes twice that when only one driving motor operates.

Figure 3:
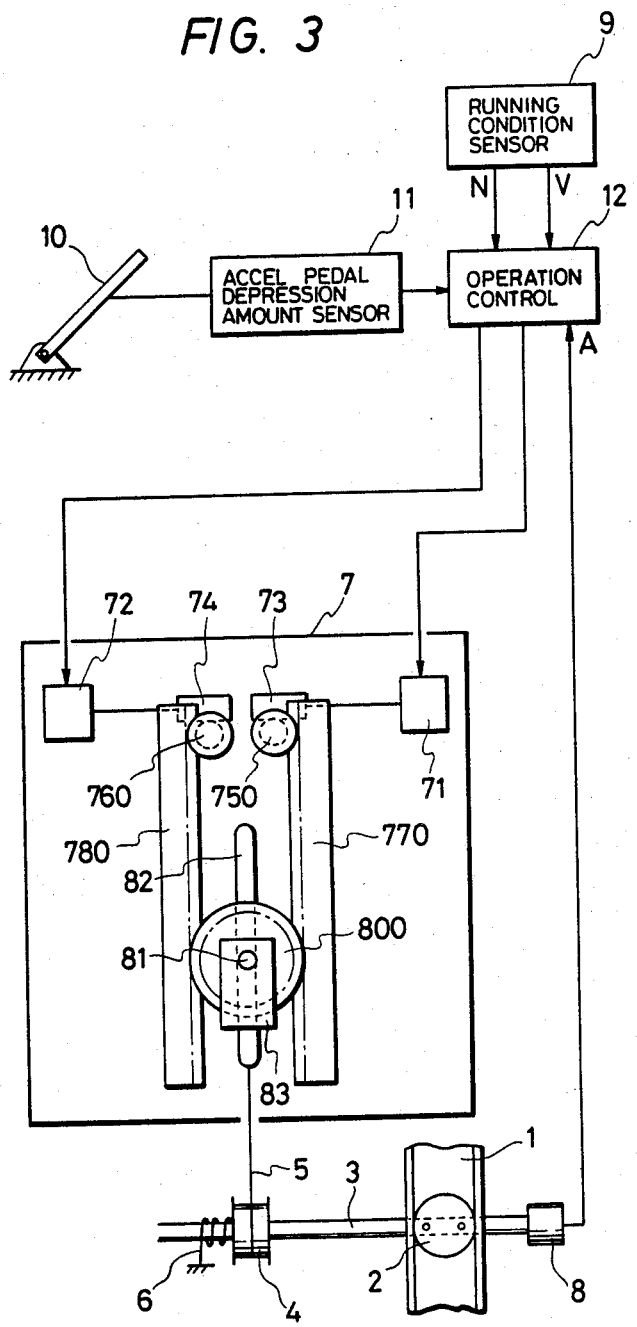

Although, in the described embodiment, the driving force conversion mechanism 70 includes the worm gears 73 and 74, the worm wheels 75 and 76, the pulleys 77, 78 and 80 and the wire 79, the construction of the driving force conversion mechanism 70 is not limited to this embodiment and it is possible to realize the mechanism by a construction shown in, for example, FIG. 3.

That is, in FIG. 3, the worm gears 73 and 74 are driven by the driving motors 71 and 72, respectively. The worm gears 73 and 74 are fixedly secured onto the shafts of the driving motors 71 and 72, respectively.

Center shafts of pinions 750 and 760 are rotatably inserted into the base 7. One ends of the pinions 750 and 760 mesh with the worm gears 73 and 74, respectively, and the other ends of these pinions mesh with racks 770 and 780, respectively. Thus, the worm gears 73 and 74, the pinions 750 and 760 and the racks 770 and 780 constitute two sets of pinion and rack assemblies.

The racks 770 and 780 are slidable on the base 7 along longitudinal directions thereof.

A gear 800 is arranged between the racks 770 and 780 in a meshing relation thereto. A center shaft 81 of the gear 800 is fitted in a groove 82 formed in the base 7 such that it is shiftable freely vertically.

A hook 83 is fitted on the center shaft 81 of the gear 800 and one end of the acceleration wire 5 is fixed to the hook 83.

An operation of the device constructed as shown in FIG. 3 will be described. Rotational forces of the driving motors 71 and 72 are transmitted independently through the worm gears 73 and 74 and the pinions 750 and 760 having the worm wheels at one ends thereof to the racks 770 and 780, respectively. Therefore, the racks 770 and 780 are driven vertically.

On the other hand, since the gear 800 meshes with the racks 770 and 780 in between them, the gear moves vertically with the vertical movements of the racks 770 and 780.

Representing the moving speeds of the racks 770 and 780 by $v_1$ and $v_2$ with moving directions inclusive and the moving speed of the gear 800 by $v_o$, a relation of $v_o = (v_1 + v_2)/2$ is established as in the case shown in FIG. 2 so long as the two sets of gear mechanisms arranged in an opposing relation have identical specifications.

Although, in the above mentioned embodiment, the acceleration wire 5 and the disc 5 are used as means for operating the throttle valve 2, it is needless to say that the same effect may be obtained by using a link coupling.

I claim:

1. A throttle valve control device comprising a first and second driving motor, a driving force conversion mechanism for combining rotational movements of said first and said second driving motors and converting a combined movements into a linear movement, a throttle valve having an opening regulated according to the linear movement transmitted from said driving force conversion mechanism to vary an output of an engine and an operation control portion for calculating an aimed opening of said throttle valve on the basis of an opening information of said throttle valve, a running condition information of an automobile and a depression amount of an acceleration pedal and supplying rotation instructions to said first and said second driving motors such that a deviation between the opening of said throttle valve and an output signal of an opening sensor becomes zero.

2. The throttle valve control device as claimed in claim 1, wherein said driving force conversion mechanism comprises a first and second pulley adapted to be driven through worm gears driven independently by said first and said second driving motors, respectively, a wire arranged between said first and said second pulleys and having ends connected to said first and said second pulleys, respectively, said wire capable of being wound on said first and said second pulleys, and a third pulley arranged between said first and said second pulleys and slidable with respect to said wire, whereby an opening of said throttle valve is regulated by a movement of said third pulley.

3. The throttle valve control device as claimed in claim 1, wherein said driving force conversion mechanism is constituted with a first and second rack-pinion mechanism arranged such that said first and said second rack-pinion mechanisms are driven by said first and said second driving motors, respectively and independently, so that a single gear is operated thereby differentially, whereby an opening of said throttle valve is regulated by a movement of said single gear.

4. The throttle valve control device as claimed in claim 3, wherein said first and said second rack-pinion mechanisms comprise a first and second worm gear driven by said first and said second driving motors and a first and second pinion meshed with said first and said second worm gears and a first and second rack respectively.

* * * * *